United States Patent [19]

Traini et al.

[11] Patent Number: 5,015,345

[45] Date of Patent: May 14, 1991

[54] METHOD FOR DETECTING DEFECTIVE ION EXCHANGE MEMBRANES IN MONOPOLAR AND BIPOLAR ELECTROLYZERS

[75] Inventors: Carlo Traini, Milan, Italy; Corrado Mojana, Singapore, China; Carlo Gusmini, Treviglio, Italy

[73] Assignee: DeNora Permelec S.p.A., Milan, Italy

[21] Appl. No.: 391,559

[22] PCT Filed: Dec. 16, 1988

[86] PCT No.: PCT/EP88/01170

§ 371 Date: Jul. 24, 1989

§ 102(e) Date: Jul. 24, 1989

[87] PCT Pub. No.: WO89/05873

PCT Pub. Date: Jun. 29, 1989

[30] Foreign Application Priority Data

Dec. 18, 1987 [IT] Italy ..... 23077

[51] Int. Cl.[5] ..... C25B 1/16; C25B 15/00

[52] U.S. Cl. ..... 204/98; 204/128; 204/153.1

[58] Field of Search ..... 204/98, 128, 1 T, 401, 204/153.1; 324/554, 557

[56] References Cited

FOREIGN PATENT DOCUMENTS 0124204 11/1984 European Pat. Off. .

OTHER PUBLICATIONS

Patent Abstracts of Japan, vol. 10, No. 355(C-388)(2411), Nov. 29, 1986.

Chem. Abstracts, vol. 105, No. 20, Nov. 17, 1986, Columbus, Ohio), p. 531, Abstract 180515q.

*Primary Examiner*—John F. Niebling

*Assistant Examiner*—Kathryn Gorgos

*Attorney, Agent, or Firm*—Bierman and Muserlian

[57] ABSTRACT

The present invention discloses a method for identifying defective ion exchange membranes installed in monopolar and/or bipolar electrolyzers for chlor-alkali production. The method of the present invention comprises reducing the electric load of the electrolyzer down to 2 to 10% of the normal load and under these reduced load conditions, a measurement of the single electric current load absorbed by each elementary cell in a monopolar electrolyzer is effected as well as the measurement of the single electric voltage of the elementary cell in the case of bipolar electrolyzers. The method further comprises calculating the deviations of the single current or voltages with respect to average values. All membranes which present values comprised between a determined threshold value are considered as suitable for operation.

9 Claims, 6 Drawing Sheets

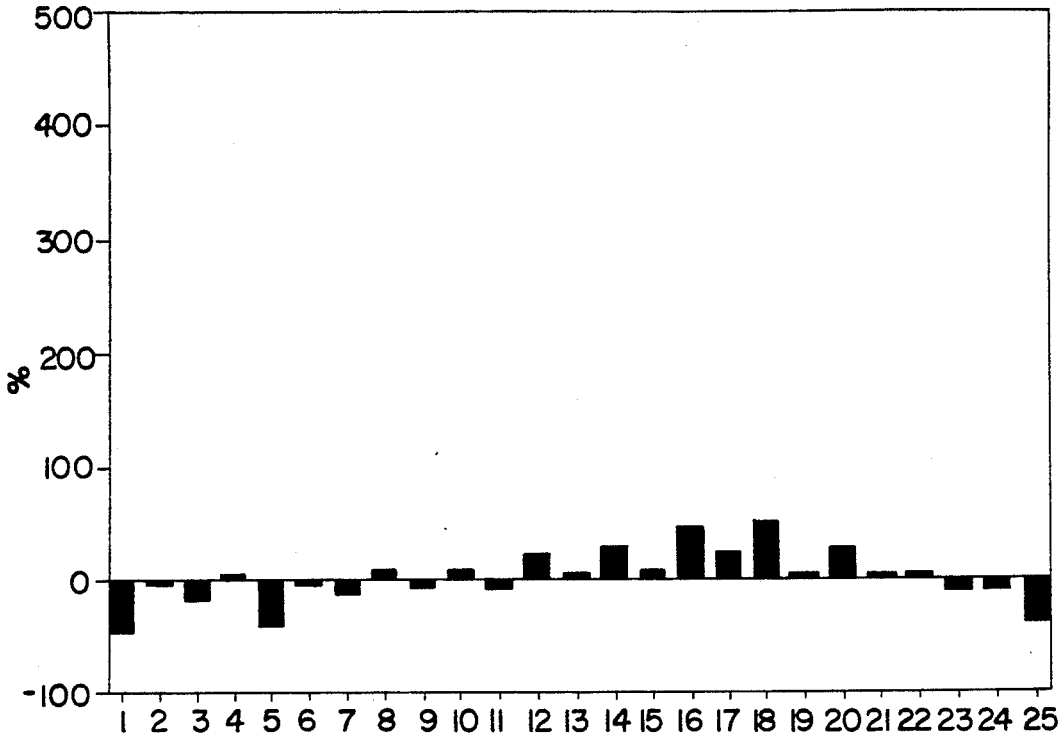
FIG.10
FIG.11
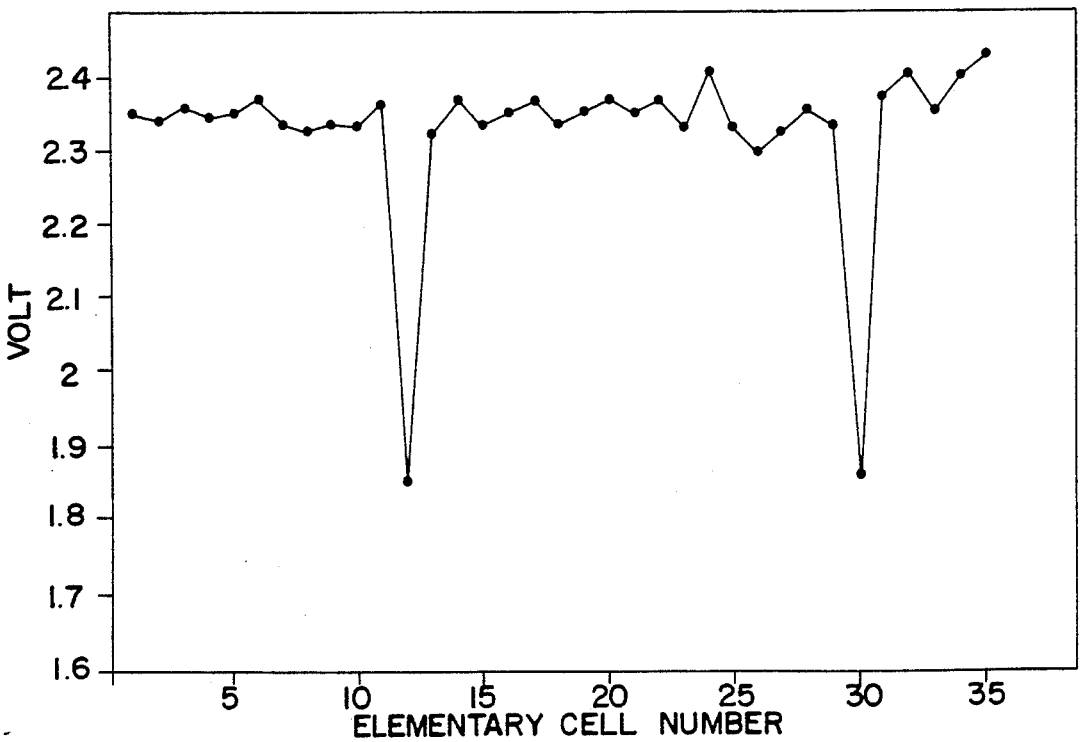

METHOD FOR DETECTING DEFECTIVE ION EXCHANGE MEMBRANES IN MONOPOLAR AND BIPOLAR ELECTROLYZERS

DESCRIPTION OF THE INVENTION

The industrial technologies presently available for chlorine and caustic soda production by electrolysis of aqueous solutions of alkali metal halide, are based on mercury cathode electrolysis cells, porous diaphragm bipolar and monopolar electrolyzers and ion exchange membranes monopolar and bipolar electrolyzers.

The monopolar or bipolar electrolyzers having diaphragm electrolyte permeable diaphragms or ion exchange membranes substantially impermeable to electrolyte flow comprise a row of elementary cells; each cell of which comprises an anode and a cathode separated by a diaphragm such as an ion exchange diaphragm. In the case of a bipolar electrolyzer, an electrolyzing voltage or potential is imposed across the entire row whereby current flows through successive elementary cells of the row from anode to cathode of each cell and then to the anode of the next adjacent cell in the row.

The monopolar electrolyzer comprises a row of separate elementary cells, each cell having an anode and a cathode with the anodes of the cells individually connected to a common positive potential source and the cathodes individually connected to a common negative potential surface.

Typical monopolar electrolyzers of the type contemplated are disclosed in U.S. Pat. No. 4,341,604 and WO 84/02537.

Typical bipolar electrolyzers contemplated are disclosed in U.S. Pat. No. 4,488,946.

The ion exchange membrane technology, notwithstanding a certain depression of the market, is continuously expanding and most certainly will be the preferred choice for plants of future construction. The reasons for this success are essentially based both on lower power consumption, in the range of 2400–2600 kWh/ton of produced chlorine, and absence of ecological problems, which were the reason for the block of the investments on mercury plants.

The improvements attained so far in regard to the anodes and flexible covers lifetime, cleaning of the cell by rakes operated from outside the cell, and on demercurization treatments of gaseous and liquid effluents allow for the construction of mercury cathode electrolyzers which comply with the most severe environment protection requirements; anyway, the fear of mercury pollution (mercury is in fact one of the most poisoning agents both for the environment and for man) causes an emotional rejection by the authorities and the public, so strong that it will never be overcome.

A similar situation is experienced in regards to porous diaphragm electrolyzers: the main component of the diaphragm is asbestos, which is well-known as a cancerogenic element. The problems here arise before the electrolysis cell; the progressive closing of mines due the unbearable expenses for providing safe conditions for the workers, make really troublesome the availability of asbestos.

The above difficulties brought to a great effort and huge investments in research programs directed to finding alternative materials to asbestos. The new types of diaphragm, although more expensive, are today commercially available, but all the same, the porous diaphragm industry today cannot be competitive versus the ion-exchange membrane technology. As a matter of fact, porous diaphragm electrolyzers produce a mixed solution of halide and alkali hydroxide, which mixture must be evaporated and only upon separation of the halide a concentrated alkali hydroxide is obtained. These steps involve a higher power consumption than that of ion exchange membrane plants.

To fully appreciate the advantages of the present invention, the principles of alkali halide electrolysis utilizing ion-exchange membrane plants will be described and the two types of electrolyzers which may be equipped with ion exchange membranes will be discussed.

For the sake of simplicity the following description will make reference only to electrolysis of aqueous solutions of sodium chloride for producing chlorine and sodium hydroxide; anyway, all the concepts and conclusions reported herein also apply to the electrolysis of any aqueous solutions of alkali halide and, therefore, are not to be intended as a limitation of the present invention to the electrolysis of sodium chloride solutions.

In chlor-alkali electrolysis, the fundamental component is constituted by the electrolytic cell, conventionally having the form of a parallelepiped; an ion exchange membrane divides the cell in an anodic compartment and a cathodic compartment. The anodic compartment contains a concentrated solution of sodium chloride, e.g. 250 g/l, wherein the anode is immersed; said anode being usually constituted by a foraminous or expanded metal, coated by a platinum group metal oxide coating, commercially known under the trade-mark DSA(R). The cathodic compartment contains a sodium hydroxide solution, e.g. 30–35% by weight, wherein a cathode is immersed; said cathode being constituted by a foraminous steel or nickel sheet, which may be coated by an electrocatalytic coating for hydrogen evolution.

The operating temperature is usually between 80° and 90° C.

The ion exchange membrane is substantially constituted by a thin sheet of a perfluorinated polymer on whose backbone ionic groups of the sulphonic or carboxylic type are inserted. These ionic groups under electrolysis are ionized, and, therefore, the polymer backbone is characterized by the presence of negative charges at pre-determined distances. These negative charges constitute a barrier against migration of anions, that is ions having a negative charge, which are present in the solutions, specifically chlorides, Cl— and hydroxyl ions, OH—. Conversely, the membrane is easily crossed by cations, that is ions having a positive charge, in this specific case sodium ions, Na+.

When continuous electric current supplied by a rectifier is fed to the electrolytic cell and, in particular, when the cathode is connected to the negative pole and the anode to the positive pole, the following phenomena take place:

anode: chlorine evolution with the consumption of chloride ions cathode: water electrolysis with hydrogen evolution, formation of hydroxyl ions, OH— and water consumption.

membrane: sodium ions, Na+, migration from the anode compartment to the cathode compartment.

Therefore, the overall balance of the above reactions results in the production of chlorine and consumption of sodium chloride in the anode compartment, hydrogen and sodium hydroxide production in the cathode compartment.

The energy consumption rate (kW) per ton of produced chlorine results from the following formula:

$$Kw = \frac{V \cdot Q \cdot 1000}{35 \cdot n} \quad (1)$$

wherein V is the voltage applied to the electrolytic cell poles (anode and cathode) to obtain a current flow expressed in Ampere/square meter of electrodic surface; Q is the quantity of electricity sufficient to obtain a reference quantity of chlorine, expressed in the present case as Kilo-Ampere (kAh) per kilo-equivalent quantity of chlorine corresponding to 26.8 kAh per 35 kg of chlorine; n is the current yield and represents the percentage of current which is actually utilized to produce chlorine (1-n is consequently the quantity of current absorbed by the parasitic reaction of oxygen evolution).

The reduction of the energy consumption per unity of product is of most concern. In the present case, the formula (1) clearly indicates that this result may be obtained by increasing the current yield, n, and decreasing the cell voltage V.

The current yield, n, depends on the type of membrane utilized: in particular, the most recent bi-layer membranes, constituted by a sulphonated polymer layer on the anode side and a carboxylated polymer layer on the cathode side, are characterized by rather high n values, in the range of 95–97%.

A reduction in the cell voltage may be obtained by reducing the gap between the anode and the cathode; the minimum distance being obtained when the anode and cathode are pressed against the anodic and cathodic surfaces of the membrane. This type of technology, so called "zero-gap configuration" is described in Italian patents Nos. 1.118.243, 1.122.699 and Italian Patent Application No. 19502 A/80.

In the case a membrane is damaged (holes, piercing more or less extended), the electrolytic cell in general and more particular a zero-gap cell, is negatively affected by the following shortcomings:

remarkable diffusion of sodium hydroxide in the anode compartment containing the sodium chloride solution. As a consequence, oxygen evolution is higher than the normal value, affecting the quality of the produced chlorine.

the risk of short-circuits between anode and cathode is increased, and this may cause overheating and damage to the electrode and to the structures of the cell itself.

corrosion of the anode. This is due to the higher pressure maintained in the cathodic compartment with respect to the anodic compartment. Therefore, in correspondence of defects on the membrane, a sodium hydroxide jet is formed which is not immediately diluted; this highly alkaline jet starts a quick corrosive attack of all titanium parts which come into contact with the same, first of all the anode.

From the above discussion, it is soon clear that a practical method for readily detecting micro-defects on the membrane is of the outmost importance to avoid that these micro-defects increase to such an extent as to cause the above mentioned problems. Further, such a method must be easy to carry out without interfering with the normal operation of the plant and should be able to detect the defective membrane among the many membranes installed on each electrolyzer.

As a matter of fact, the electrolytic cell referred to so far is only the unit element of an electrolyzer which is constituted by a high number of cells (from 20 to 60). The possibility to know exactly which membrane, among the many installed, is really defective permits the opening of the electrolyzer in the very point where the substitution of the defective membrane has to occur. The savings in terms of time with respect to a total disassembling of the electrolyzer and visual inspection of each membrane installed goes without saying. It must be added that the membranes passing from operating conditions to inspection conditions are subjected to remarkable differences in temperature and water content, which cause noticeable dimensional variations. In other words, during the inspection, the membranes are subjected to mechanical and chemical stresses which may also damage those membranes which were free from damages during operation.

Experience teaches that it is quite easy to detect those electrolyzers having damaged membranes, but it is really complicated to find out which one of the many membranes in an electrolyzer is really defective, in order to effect a localized maintenance.

As aforesaid, a high diffusion of alkali hydroxide in the anode compartment causes a substantial increase in the amount of oxygen in the produced chlorine. Obviously, this increased content of oxygen takes place only in those anodic compartments contacting a defective membrane: for example, in an electrolyzer constituted by 24 unit cells wherein one of the 24 membranes is defective, a higher oxygen content will be found only in the unit cell containing the defective membrane. In the remaining 23 cells, the oxygen content will remain within normal values. Conventional electrolyzers are equipped with a manifold collecting the chlorine produced in the various elementary cells; therefore, the higher quantity of oxygen in the chlorine coming from a cell having a defective membrane is diluted in the overall produced chlorine. As a consequence, the analysis of the produced chlorine to detect an anomalous oxygen content is effective only in cases of major damage to the membrane.

The logical solution of analyzing the chlorine produced in each elementary cell is not feasible as the mechanical structure of an electrolyzer does not allow for withdrawing gases other than from the manifold. As a conclusion, a routine analysis of the produced gas from the manifold is an expensive procedure which allows only for detecting those electrolyzers having one or more damaged membranes but is useless in regards to ascertaining the exact position of defective membranes inside said electrolyzer.

Once the defective electrolyzer is detected, the usual procedure foresees shut-down, extraction from the production line and transport to suitable maintenance area. Here the electrolyzers, anode compartment previously emptied, is slowly filled with diluted brine; inspection is effected by means of optic fibers endoscopes to find out which cathode compartments present brine leakage. The level of brine in the anode compartment provides for localizing the defect in the vertical direction. It is soon evident that the procedure is time-consuming and not very reliable in the presence of micro-defects.

A second solution is represented by the analysis of the voltages and current load values of each electrolytic cell constituting an industrial electrolyzer. Before getting into details in regards to this alternative solution, the two different types of electric connection in monopolar and bipolar electrolytic cells is described.

BRIEF DESCRIPTION OF THE DRAWINGS

Refering now to the drawings

FIG. 10 is a graph of percentage deviations vs average current loads of a second monopolar electrolyzer.

Figure 1:
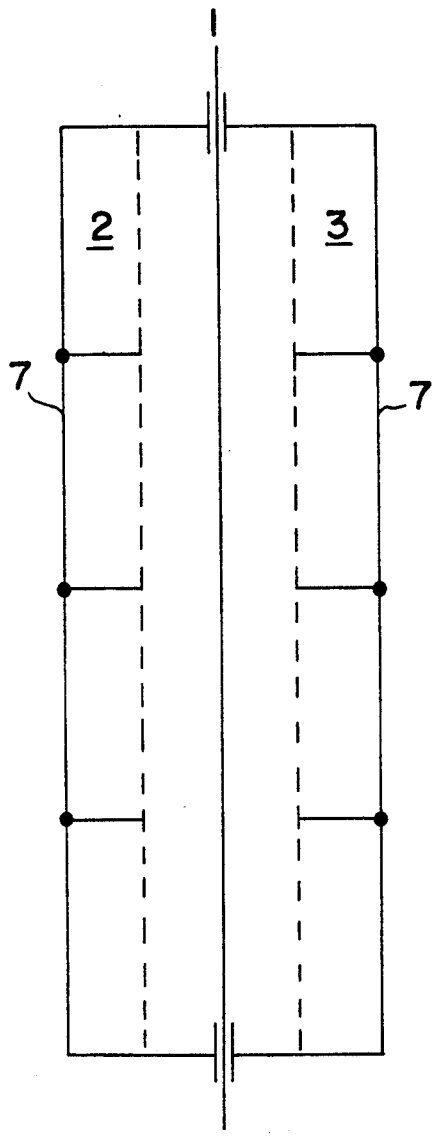
FIG. 1 is a schematic view of an elementary cell of an electrolyzer.

As aforesaid, the fundamental component of an electrolyzer is the elementary cell, schematized in FIG. 1. The cell comprises two half-cells each one characterized by one end-wall (7), the end-wall (7) of one halfcell is connected to an anode (2) and one end-wall (7) of the other half-cell is connected to a cathode (3). The two half-cells constitute the anodic and cathodic compartments which are separated by an ion-exchange membrane (1).

A typical industrial elementary electrolytic cell has an electrodic surface between 0.5 and 5 square meters, corresponding to a daily production of 50–5000 kg of chlorine operating at a current density of 3000 A/square meter. To avoid excessive spreading of the overall production capacity of the plant (average values: 100–500 ton/day) and to save on the costs of the electrical connections, the elementary electrolytic cells are assembled so as to form an electrolyzer, according to two possible schemes as illustrated in FIG. 2, monopolar electrolyzer, and in FIG. 3, bipolar electrolyzer.

Figure 2:
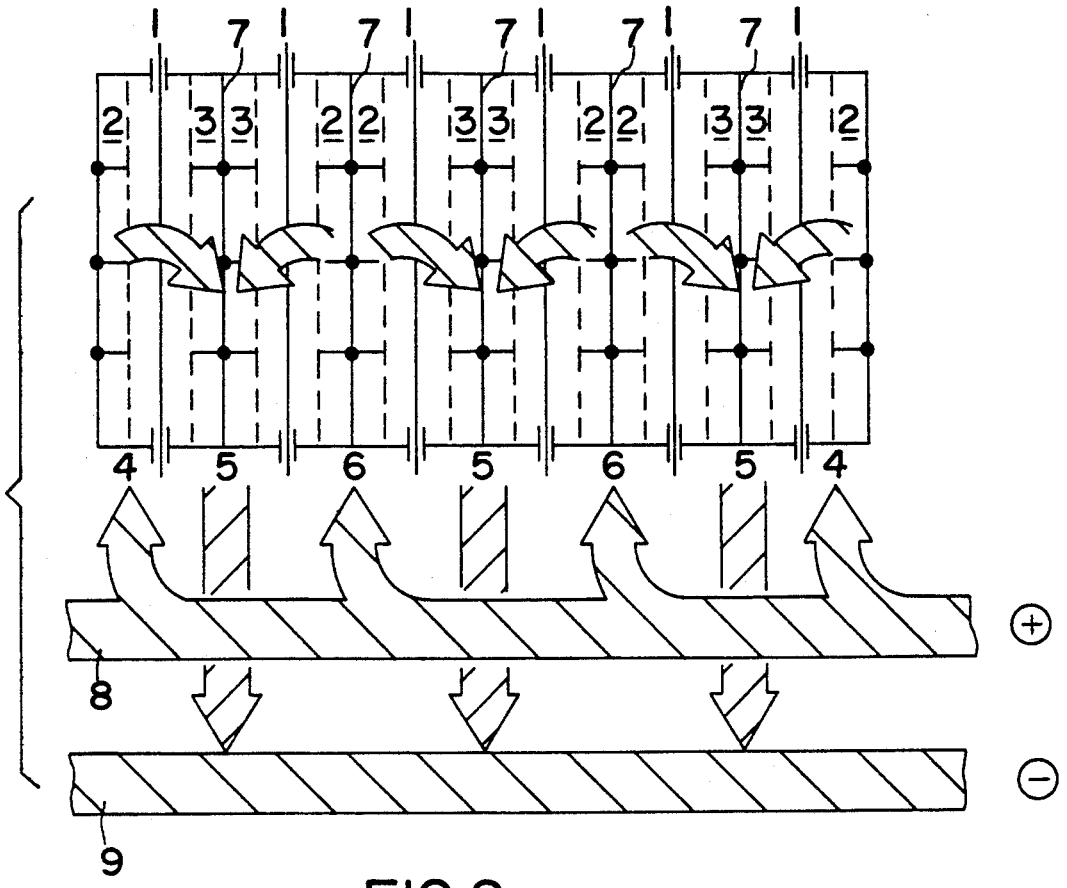
FIGS. 2 and 3 are schematic views of the electric distribution in a monopolar and bipolar electrolysis cell, respectively.
Figure 3:
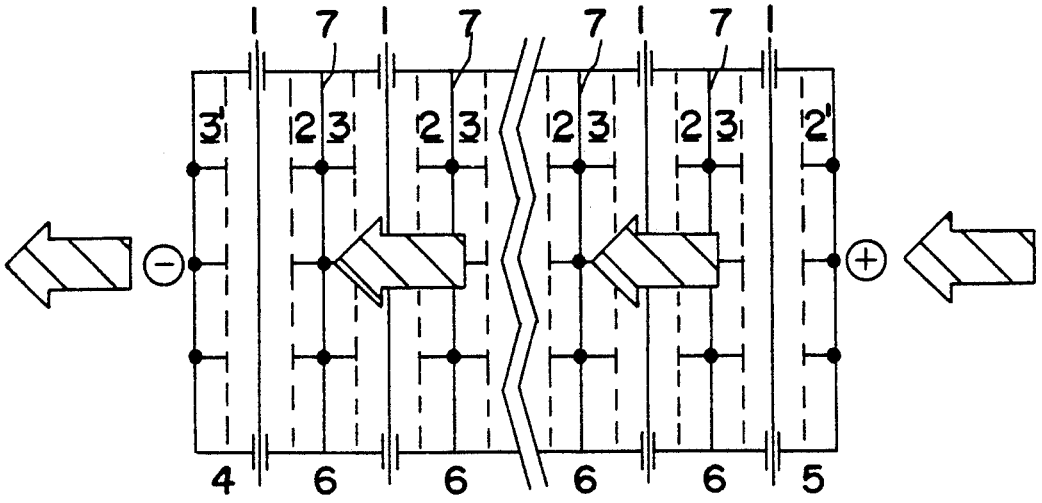

FIGS. 2 and 3 clearly show that in both types of electrolyzer the end walls of two adjacent elementary cells are merged together to form a single wall (7), monopolar in FIG. 2 and bipolar in FIG. 3. This schematization corresponds to a real constructive solution; as an alternative the monopolar and bipolar walls may be constituted by two separate end-walls of two subsequent cells pressed together. A compressible conductive element may be interposed between two adjacent cells in order to provide for an even current distribution on the whole contact area (see Italian Patent No. 1,140,510).

FIG. 2 shows a monopolar electrolyzer wherein all the anodes (2) and cathodes (3), separated by an ion exchange membrane (1), are connected one by one, respectively, to the anodic bus bar (8) and the cathodic bus bar (9), which are in turn connected to the positive and negative pole of a rectifier. In this case, the electric behavior of the electrolyzer is the same as that of a system constituted by a certain number of ohmic resistances in parallel; when the system is fed with a DC voltage, in the range of 3–4 Volts, the high overall current load is distributed among the various elementary cells forming the electrolyzer (4, 5, 6) in an inversely proportional relation versus the respective resistances. If these internal resistances are sufficiently similar, the current flowing through the various elementary cells is substantially the same.

It is, therefore, clear that the monopolar electrolyzer is a system typically characterized by low voltage (3–4 V) and high current loads (50,000–100,000 Amperes).

FIG. 3 shows a bipolar electrolyzer wherein a terminal anode (2') and a terminal cathode (3') are connected to the positive and negative poles of a rectifier. In this case, a predetermined electric current is fed to the first cell (5) and always and only the same electric current is forced through the elementary cells (6) to reach the last elementary cell in the series.

The amount of current is typically lower than that absorbed by a monopolar electrolyzer. On the other end, each crossing of an elementary cell requires for a determined voltage; therefore, the total voltage of the electrolyzer will correspond to the sum of the voltages of each elementary cell. It is, therefore, evident that the total voltage is remarkably higher than that required by a monopolar electrolyzer.

In a bipolar electrolyzer, each single wall (7) bears an anode on one side and a cathode on the other side, that is why it is called bipolar. Conversely, in a monopolar electrolyzer each single wall (7) bears either a couple of anodes or a couple of cathodes and for this reason, it is called monopolar.

A bipolar electrolyzer may be considered as the complementary image of the monopolar electrolyzer being characterized by high voltage and low current densities.

As a conclusion, taking into account that for producing a determined quantity of chlorine per day, a determined electric power is required; it is obvious that this electric power is utilized in terms of high current loads in a monopolar electrolyzer while it is utilized in terms of high voltage in a bipolar electrolyzer.

The electrical parameters characterizing the behavior of the two types of electrolyzers may be resumed as follows:

monopolar electrolyzer: voltage at the bus-bar, total current, current to each elementary cell;

bipolar electrolyzer: total voltage at the bus-bar, voltage of elementary cells, total current.

Practical experience demonstrates that none of the above parameters permits the detection of, among the many electrolyzers in a plant, those electrolyzers wherein there are membranes exhibiting micro-defects at the initial stage. Only when these micro-defects reach hazardous dimensions, a certain decrease in the overall voltage of the electrolyzer is detected; from this standpoint, an analysis of the oxygen content in chlorine certainly provides more timely indications on the degree of the damage.

It is obvious that the electrical parameters, which are insufficient to permit detection of an electrolyzer containing defective membrane, are even more useless for a preventive localization of defective membranes inside a determined electrolyzer.

It has now been surprisingly found by the inventors that the electrical parameters allow for detecting defective membranes with a high degree of reliability when the various measurements are made after reducing but not interrupting the electric current load.

The present invention provides for a method for detecting defective ion exchange membranes in monopolar or bipolar electrolyzers constituted by elementary electrolytic cells and is carried out by the following steps:

reducing the total current load;

measuring the single cell current values;

calculating the percentage deviation of said values with respect to the average values;

recording any deviation higher than 100%; the cells exhibiting lower deviations being suitable for operation.

It should be noted that the measurement of the current fed to each elementary cell, under reduced current load, does not interfere with the operation of the plant. First of all, the measurement requires only that fixed electrical contacts be applied, possibly welded, to the flexible connections of each elementary cell, and this is an easy and cheap operation. The various electrical contacts may be connected by means of a suitable multiplexer to the computer which operates automatically the plant; in this case, the voltage values of the elementary cells are directly recorded on the data sheets printed out by the computer.

Significant data may be collected during shut-downs for the periodical maintanance of the various equipments (chlorine compressors, hydrogen compressors). Under these conditions, the electrolyzers are fed with a small amount of current, substantially reduced with respect to the operating conditions. Anyway, data may be collected more frequently if the plant is provided with a step-shunter which may be connected periodically to each electrolyzer and permits the reduction of current load to the desired values (1000–3000 Ampere in DD88 electrolyzers) without interfering with the operation of the remaining electrolyzers of the plant.

EXAMPLE 1

Figure 4:
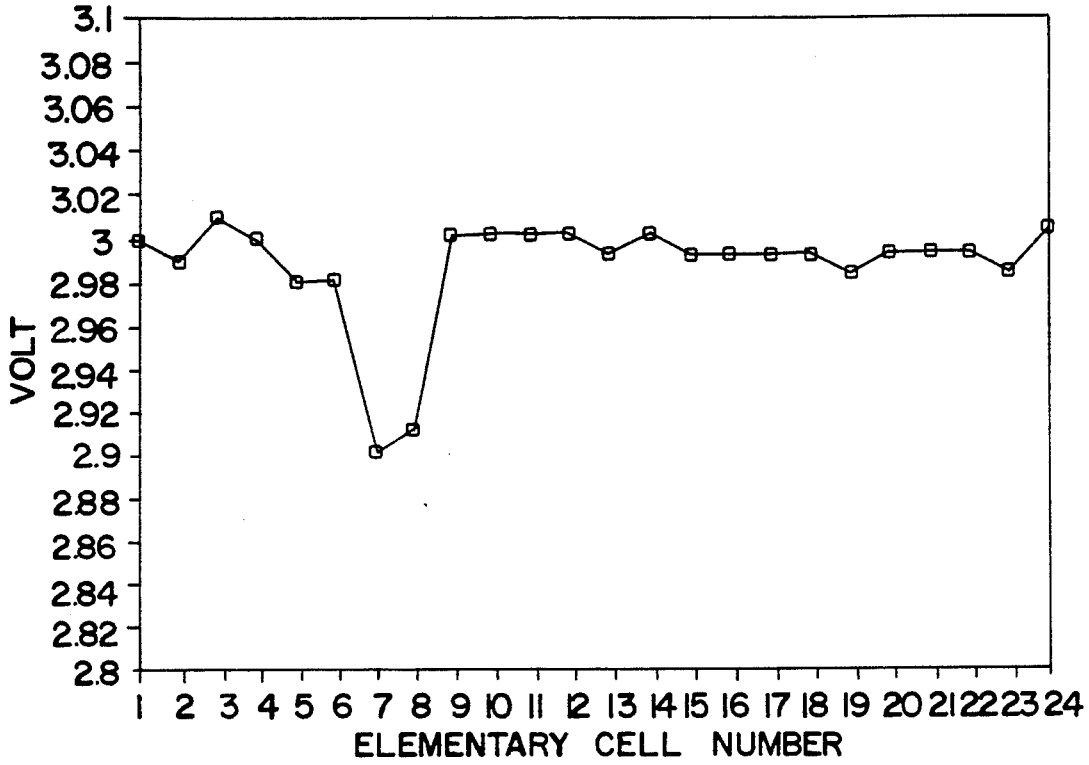
FIGS. 4, 5, 6, 7, 8 and 9 are graphs showing the electrolyzer and a bipolar electrolyzer, respectively.
Figure 5:
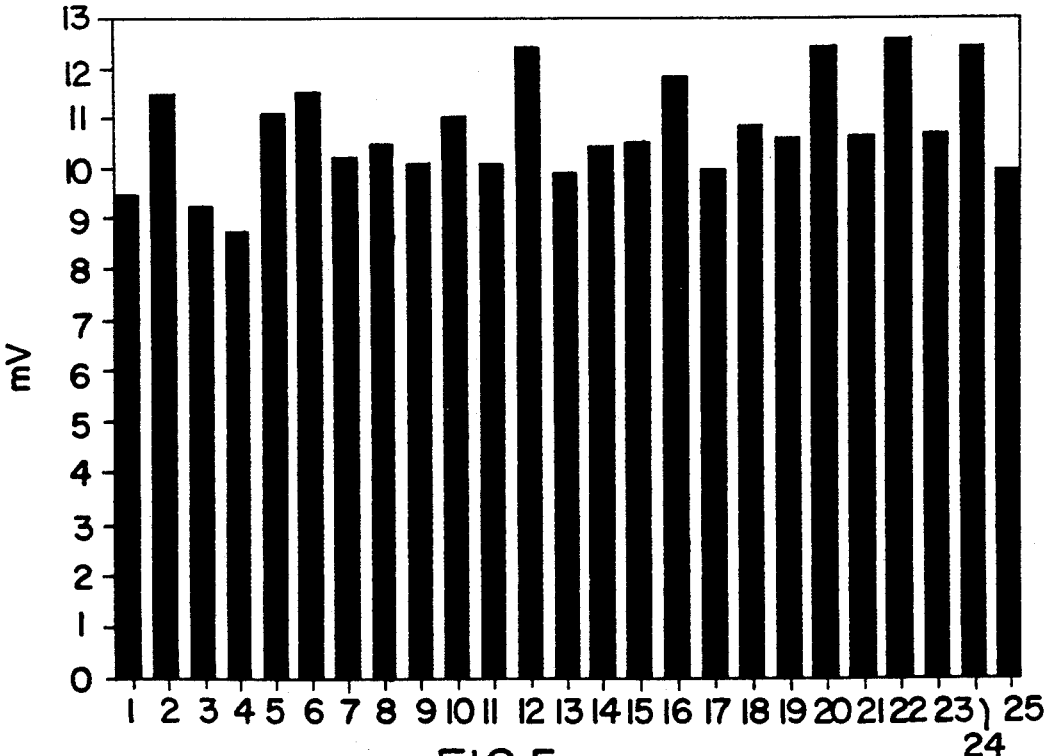
Figure 6:
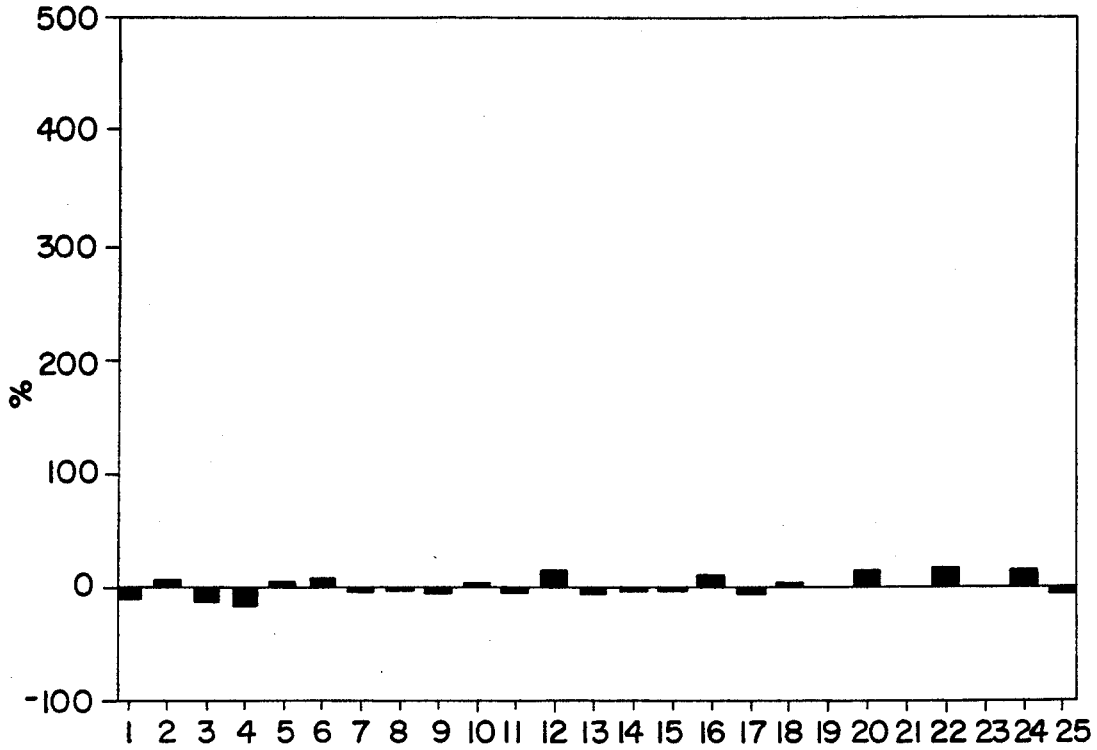

The electrical characteristics of a monopolar electrolyzer equipped with 24 electrolytic elementary cells DD88 type by O. De Nora Technologies S.p.A. (voltages and current of elementary cells) were detected at an overall current load of 61,000 A, corresponding to a current density of 3000 A/m2. The relevant data are graphically shown in FIGS. 4,5 and 6 are collected in Table 1. In particular:

FIG. 4 shows the voltages of each elementary cell at a total current load of 61,000 A. All elementary cells are characterized by a value close to 3 V with the only exceptions cells 7 and 8, the voltage of which is 2.9 and 2.91 V respectively. Also, these values, however, are within standard values. In fact, upon collecting all the data, the electrolyzer was shut-down and disassembled: no damages on the membranes were found upon visual inspection, including membranes 7 and 8; the only exception being represented by the membrane of elementary cell 24 of the graph, interposed between anode 24 and cathode 25, which showed small holes all around the periphery, in the gasket area.

FIG. 5 shows the distribution of the total current load, 61000 A, to the various elementary cells, effected by measuring the ohmic drop onto the flexible connections of each cell to the anodic and cathodic bus bars; therefore, the current loads fed to each elementary cell are given as the ohmic drops in millivolt (mV) rather than as absolute values (Amperes). The average value resulted 10 mV with a maximum value of 12 mV and a minimum of 9 mV, which could never be connected to the position of the defective membrane (between anode 24 and cathode 25).

FIG. 6 presents an elaboration of the data of FIG. 5 in terms of a percent deviation versus the average value: the sharpest deviation is 20%.

Also, the measurement of the voltages of each elementary cell in monopolar and bipolar electrolyzers out of operation but still containing the normal volumes of sodium chloride solutions in the anode compartments and sodium hydroxide in the cathode compartments is scarcely significant. The deviations cannot be related to the defects on the membranes but are rather a function of the residue contents of chlorine in the anode compartments and probably of temperature distribution through the electrolyzer.

Before disassembling the electrolyzer and inspecting each single membrane, the total current load was brought down to 1500 Ampere and then to 1000 Ampere, from the full load of 61,000 Ampere.

Figure 7:
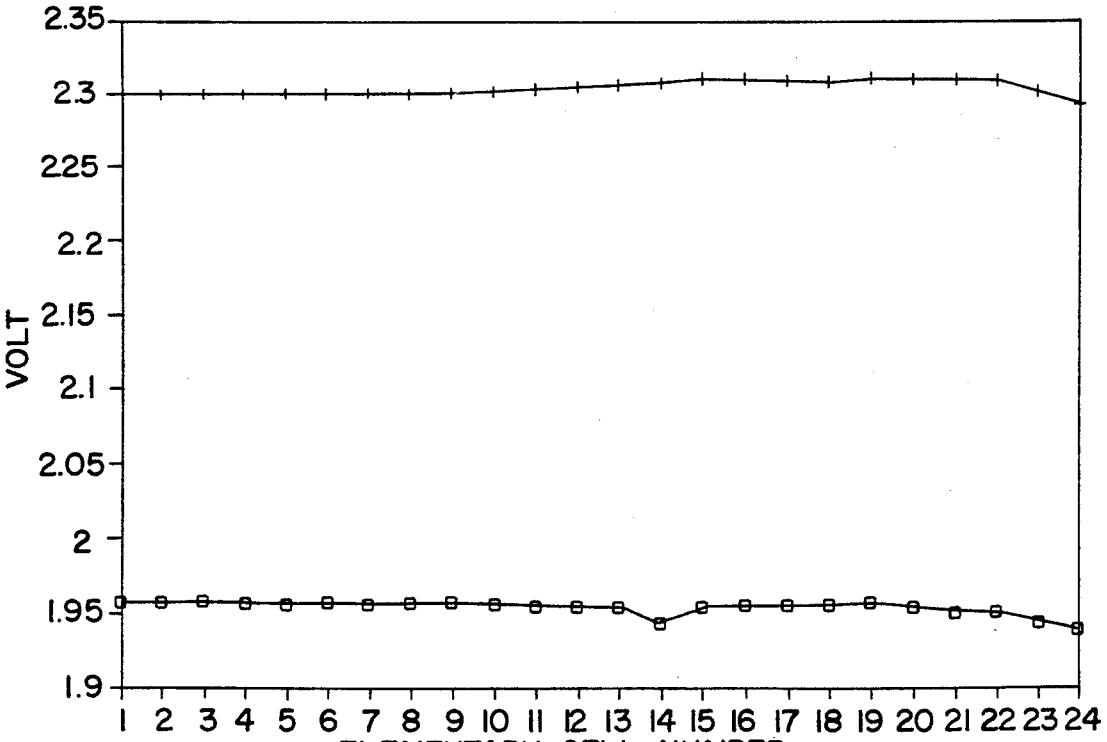
Figure 8:
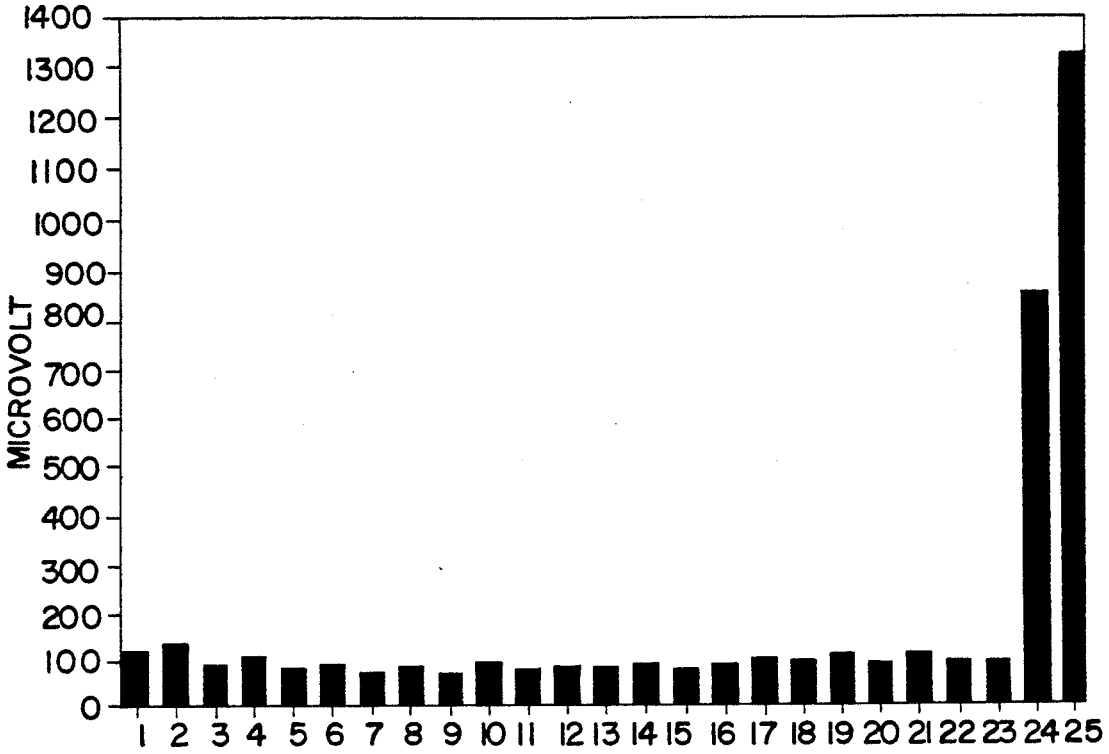
Figure 9:
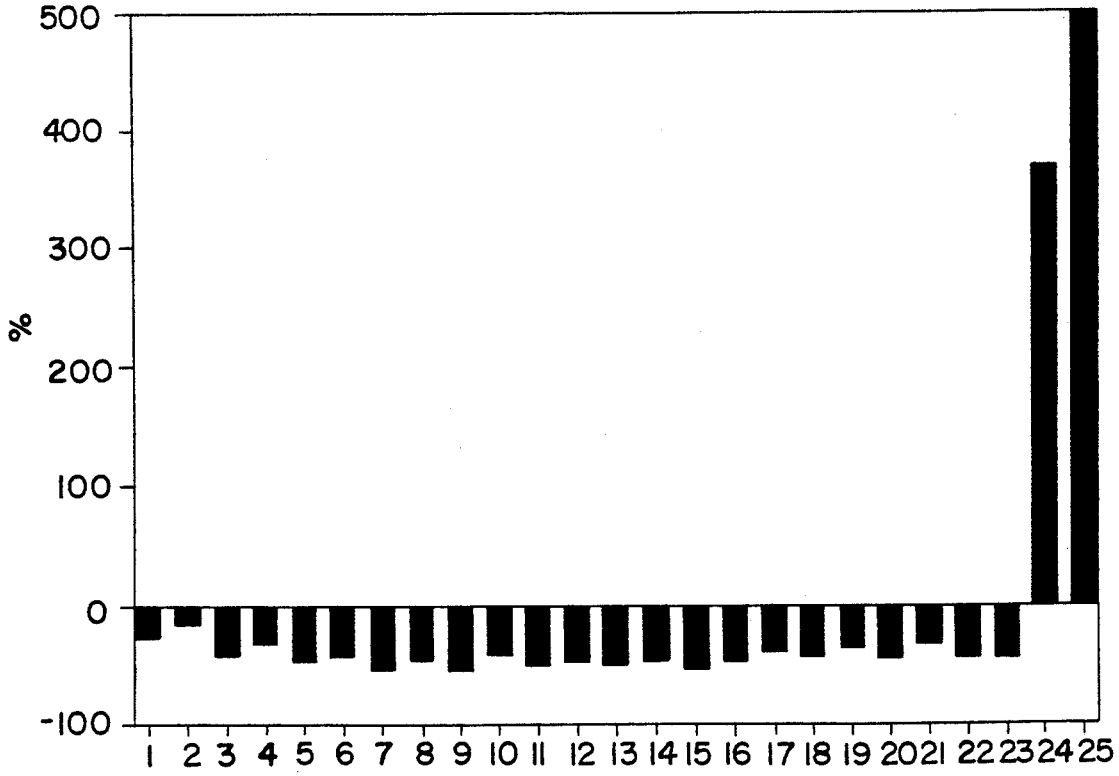

The voltage and current values of the elementary cells and the deviations from percentage of the current values are graphically shown in FIGS. 7, 8 and 9 and are collected in Table 2. In particular:

FIG. 7 shows that, as far as the voltages of the elementary cells are concerned, no anomalous deviation is observed to suggest that defects are present on the membrane of cell no. 24, which later, upon disassembling of the electrolyzer and inspection of all of the membranes, was found to be defective FIG. 8 shows the current values recorded on the flexible connections of each elementary cell to the anodic and cathodic bus bars. In this case, as in FIG. 5, the ohmic drop values are directly reported (microvolts) instead of the total Ampere values. It is soon apparent that the current fed to cell 24 and in particular to anode 24 and cathode 25 strongly deviates (1330 and 850 microvolts) from the typical value of the other elementary cells (about 100 microvolts). As aforesaid, membrane 24, between anode 24 and cathode 25 was found to be defective upon visual inspection of all of the membranes installed on said electrolyzer.

FIG. 9 represents an elaboration of the values of FIG. 8 as percentage deviation; it is soon apparent that the current density values of anode 24 and cathode 25 are characterized by a very high deviation in the range of 400–500%.

As aforesaid, after collecting all electrical values, the electrolyzer was shut-down, removed from the production line and transferred to a suitable service area and disassembled: no damage was found upon visual inspection of any of the membranes; the only exception being represented by the membrane of elementary cell no. 24, interposed between anode 24 and cathode 25, which showed small holes all around the periphery, in the gasket area.

The effectiveness of the present invention was further confirmed when repeating the measurement of all of the elementary cells on another electrolyzer DD88 type operating at full electrical load for 5 months.

FIG. 10 shows the percentage deviations vs. the average value of the current loads fed to each elementary cell for a second monopolar electrolyzer, equivalent to the one considered so far.

The maximum deviations are in the range of 50% and can be considered as acceptable. In fact, when the second electrolyzer was shut down and disassembled, all the membranes subjected to visual inspection resulted free from remarkable defects.

EXAMPLE 2

The same considerations made for Example 1 also apply to bipolar electrolyzer wherein the electrical parameter to be taken into consideration is the cell voltage in this type of electrolyzer, the elementary cells are forcedly crossed by the same electric current, as discussed before.

FIG. 11 refers to a bipolar electrolyzer DD 88 by Oronzio de Nora Technologies S.p.A. fed with 50 A (nominal load 1200 A) and shows the elementary cells voltages: the values relating to cells, nos. 12 and 30 (1.85 V) are substantially lower than those of the remaining cells (about 2.35 V). A visual inspection of the membranes showed that the two membranes corresponding to cells nos. 12 and 30 were affected by several defects in the form of blisters. All of the remaining membranes were in optimum conditions.

TABLE I

Electrical characteristics of a monopolar DD 88 membrane electrolyzer under a full load of 61,000 Ampere, corresponding to a current density of 3000 Ampere/square meter

| Elementary Cell, No. | Cell Voltage Volts | Measured Currents Electrode No. (*) | Measured Currents Electrode mV | Measured Current Deviation from average value % |
|---|---|---|---|---|
| 1 | 3.00 | 1 | 9.5 | −12 |
| 2 | 2.99 | 2 | 11.5 | +12 |
| 3 | 3.01 | 3 | 9.3 | −14 |
| 4 | 3.00 | 4 | 8.7 | −20 |
| 5 | 2.98 | 5 | 11.0 | +2 |
| 6 | 2.98 | 6 | 11.5 | +7 |
| 7 | 2.90 | 7 | 10.2 | −6 |
| 8 | 2.91 | 8 | 10.5 | −3 |
| 9 | 3.00 | 9 | 10.0 | −7 |
| 10 | 3.00 | 10 | 11.0 | +2 |
| 11 | 3.00 | 11 | 10.0 | −7 |
| 12 | 3.00 | 12 | 12.5 | −16 |
| 13 | 2.99 | 13 | 10.0 | −7 |
| 14 | 3.00 | 14 | 10.6 | −2 |
| 15 | 2.99 | 15 | 10.7 | −1 |
| 16 | 2.99 | 16 | 11.9 | +10 |
| 17 | 2.99 | 17 | 10.0 | −7 |
| 18 | 2.99 | 18 | 11.0 | +2 |
| 19 | 2.98 | 19 | 10.7 | −1 |
| 20 | 2.99 | 20 | 12.5 | +16 |
| 21 | 2.99 | 21 | 10.7 | −1 |
| 22 | 2.99 | 22 | 12.6 | +17 |
| 23 | 2.98 | 23 | 10.8 | 0 |
| 24 | 3.00 | 24 | 12.5 | +16 |
| | | 25 | 10.0 | −7 |

*odd numbers: cathodes - even number: anodes

TABLE II

Electrical characteristics of a monopolar DD88 membrane electrolyzer under a reduced load of 1500 Ampere, corresponding to a current density of 75 Ampere/square meter

| Elementary Cell, No. | Cell Voltage Volts | Measured Currents Electrode No. (*) | Measured Currents Electrode mV | Measured Current Deviation from average value % |
|---|---|---|---|---|
| 1 | 2.30 | 1 | 130 | −28 |
| 2 | 2.30 | 2 | 150 | −17 |
| 3 | 2.30 | 3 | 100 | −45 |
| 4 | 2.30 | 4 | 120 | −34 |
| 5 | 2.30 | 5 | 90 | −50 |
| 6 | 2.30 | 6 | 100 | −45 |
| 7 | 2.30 | 7 | 80 | −55 |
| 8 | 2.30 | 8 | 100 | −45 |
| 9 | 2.30 | 9 | 70 | −61 |
| 10 | 2.31 | 10 | 100 | −45 |
| 11 | 2.31 | 11 | 90 | −50 |
| 12 | 2.31 | 12 | 100 | −45 |

-continued

| Elementary Cell, No. | Cell Voltage Volts | Measured Currents Electrode No. (*) | Measured Currents Electrode mV | Measured Current Deviation from average value % |
|---|---|---|---|---|
| 13 | 2.32 | 13 | 90 | −50 |
| 14 | 2.32 | 14 | 100 | −45 |
| 15 | 2.32 | 15 | 80 | −55 |
| 16 | 2.32 | 16 | 100 | −45 |
| 17 | 2.32 | 17 | 110 | −39 |
| 18 | 2.32 | 18 | 100 | −45 |
| 19 | 2.32 | 19 | 120 | −34 |
| 20 | 2.32 | 20 | 100 | −45 |
| 21 | 2.32 | 21 | 120 | −34 |
| 22 | 2.32 | 22 | 100 | −45 |
| 23 | 2.31 | 23 | 100 | −45 |
| 24 | 2.29 | 24 | 850 | +370 |
| | | 25 | 1330 | +635 |

*odd numbers: cathodes - even number: anodes

It is obvious that the above description is only illustrative and by no means should be intended as a limitation of the present invention.

We claim:

1. A method of locating a damaged diaphragm or ion exchange membrane in an elementary cell of an electrolyzer for the electrolysis of aqueous alkali metal halide solutions, said electrolyzer comprised of a series of elementary cells formed of an anode and a cathode separated by a diaphragm or ion exchange membrane, said method comprising detecting the value of either the elementary cell currents for the monopolar construction or the elementary cell voltages for the bipolar construction and comparing each of said values with the average value to determine abnormal deviation in any of said elementary cells characterized in that before detecting said values of elementary cell currents or voltages the total current fed to the electrolyzer operating under industrial production conditions is substantially reduced without interruption of the operation.

2. The method of claim 1 wherein the current density corresponding to said lower current load does not substantially exceed 500 Ampere per square meter of electrode surface.

3. The method of claim 1 wherein the diaphragm of an elementary cell showing a substantial deviation from the average of said electrical characteristic is visually inspected.

4. The method of claim 1 wherein the diaphragm of an elementary cell showing a deviation of the electrical current higher than 100% with respect to the average value is visually inspected.

5. The method of claim 1 wherein the diaphragm of an elementary cell showing a deviation of the voltage across it higher than 0.2 Volts with respect to the average value is visually inspected.

6. The method of claim 1 wherein the total current fed to the electrolyzer operating under industrial production conditions is reduced to less than 10% and preferably less than 2%.

7. The method of claim 6 wherein the total current is reduced to less than 2%.

8. The method of claim 1 wherein the diaphragm or membrane of an elementary cell showing a deviation of the current higher than 100% with respect to the average value is visually inspected.

9. The method of claim 1 wherein the diaphragm or membrane of an elementary cell showing a deviation of the voltage higher than 0.2 volts with respect to the average values is visually inspected.

* * * * *